United States Patent [19]

Marson

[11] Patent Number: 4,604,909

[45] Date of Patent: Aug. 12, 1986

[54] CAM-FOLLOWER TRANSFER MECHANISM FOR CONTROLLING RELATIVE ROTATIONAL MOVEMENT

[76] Inventor: James E. Marson, 9301 Interlake Ave. N., Seattle, Wash. 98103

[21] Appl. No.: 721,058

[22] Filed: Apr. 8, 1985

[51] Int. Cl.[4] ..... F02B 53/00; F04C 2/00; F16H 35/02

[52] U.S. Cl. ..... 74/63; 123/245; 418/38

[58] Field of Search ..... 74/63; 123/245, 246; 418/37, 38

[56] References Cited

U.S. PATENT DOCUMENTS

| | | | |
|---|---|---|---|
| 2,649,080 | 8/1953 | Mallinckrodt | 418/38 |
| 2,851,998 | 9/1958 | Mallinckrodt | 418/38 |
| 3,835,717 | 9/1974 | Rudolph | 74/63 |
| 4,413,961 | 11/1983 | Griffin | 74/63 |

FOREIGN PATENT DOCUMENTS

| | | | |
|---|---|---|---|
| 527598 | 7/1921 | France | 74/63 |
| 1036488 | 4/1953 | France | 74/63 |
| 708 | of 1909 | United Kingdom | 74/63 |

*Primary Examiner*—Lawrence Staab
*Attorney, Agent, or Firm*—Garrison & Stratton

[57] ABSTRACT

Two shafts rotatable about the same axis and having hubs are connected to each other by a transverse beam. One end of the beam is pivotally connected to one hub and the other end of the beam is pivotally connected to the other hub. Two roller followers are mounted to the beam with one follower located on each side of the beam's mid-point. The followers are guided by the interior surface of a closed path guide cam. In operation, the beam first pivots about the axis of one follower and then pivots about the axis of the other follower in a repetitive alternating sequence. For a given hub, the distance between the beam's pivot point and the hub connection changes each time the pivot point moves from one follower axis to the other. This causes one hub to alternately rotate at speeds which are relatively faster than, and then relatively slower than, the rotational speed of the other hub.

13 Claims, 15 Drawing Figures

CAM-FOLLOWER TRANSFER MECHANISM FOR CONTROLLING RELATIVE ROTATIONAL MOVEMENT

TECHNICAL FIELD

This invention relates to mechanical transmission and machine element apparatus, and in particular to an apparatus comprising a cam and follower for controlling the rotational movement of one rotary means relative to the rotational movement of a second rotary means.

BACKGROUND ART

Various apparatus have been proposed for controlling the rotational movement of one rotary means relative to the rotational movement of a second rotary means. Many of these apparatus have been developed for use with toroidal rotary internal combustion engines. These engines have rotary pistons orbiting in an annular cylinder. Such engines have been called "cat-and-mouse" type engines because the pistons are required to alternately approach and recede from each other, comparable to the way a cat chases a mouse, so that the volume of the chambers formed between the pistons sequentially varies during the course of the intake, compression, combustion, and exhaust phasing of such engines. To accomplish this cat-and-mouse movement, at least one piston assembly must move at a non-uniform varying speed with respect to the speed of the other piston assembly during each revolution. This is accomplished by a transfer mechanism between the shafts of the two rotary piston assemblies.

One known device comprises a planetary drive in conjunction with a crank and connecting rod arrangement. A planet carrier supporting a single planet gear and a crank is rigidly connected to one rotary means. The planet gear meshes with a stationary sun gear while another crank, rigidly connected to a second rotary means, is linked by a connecting rod, through the planet gear crank and shaft, to the planet carrier. Counterweights are applied to both cranks and to the planet carrier. The combination of gears and connecting rods result in a relatively frail mechanism with the additional disadvantage of the requirement for careful balancing of the counterweights, and the assembly takes up considerable space.

Another known construction comprises a first rotary means which causes a pivotally mounted slide block to rotate about a circular path. A connecting rod slides in the slide block. One end of the connecting rod is pivotally joined to a crank mounted on a second rotary means. The other end of the connecting rod has a roller which follows a trough-like non-circular path. While this construction has no gears, it remains relatively complex and frail, and it also requires considerable space.

It is also known to use a cam and roller arrangement wherein two diametrically opposed rollers are mounted upon each of two rotary means. The roller pair associated with a given rotary means coacts with a companion asymmetrically configured cam. The two cams are fixedly mounted in a spaced apart relationship on a single shaft. One cam is axially rotated 180 degrees with respect to the other so that their asymmetrical configurations are in diametric opposition. The configuration of each cam is such as to alternately engage with and then disengage from its associated rotary means so as to momentarily bring one rotary means to a stop while allowing the other rotary means to continue to rotate, and visa versa. This construction has the disadvantage of causing the entire rotating mass associated with each rotary means to be alternately brought to rest and then accelerated.

DISCLOSURE OF THE INVENTION

The transfer mechanism of this invention broadly comprises first and second rotary means rotatable about a common axis; motion transmitting means including a motion transmitting member with joint means at each end for pivotally connecting one end of said member to one of the rotary means and the other end to the other rotary means; two follower means which are spaced apart and mounted to the motion transmitting member with one follower means being located between one end and the mid-point of the member, and the other follower means being symmetrically located in a like position on the other side of the mid-point; and, guide means for receiving and cooperating with the follower means to cause the motion transmitting member to firstly angularly rotate or pivot about the axis of one follower means, and then to angularly rotate or pivot about the axis of the other follower means whereby the motion transmitting member, and through the joint means at each of its ends, causes one rotary means to alternately rotate at speeds which are relatively faster than, and then relatively slower than, the rotational speed of the other rotary means. At no point during the operation of this invention is it necessary for either rotary means to be brought to a complete rest and then accelerated.

The relationship between components of this invention permits flexibility to meet the requirements of various applications. Choices made at the design stage may be used to control both the number of alternations in speed which will occur during one revolution of the rotary means, and to also control the relative difference in speed between the two rotary means during each alternation. Variations are also possible in the location of the guide means with respect to the orientation of the rotary means.

The number of alternations per revolution is controlled by the contour and configuration of the guide means. One embodiment of the invention comprises a guide means having a single level which provides six alternations of the motion transmitting member during the course of each revolution of the rotary means. The preferred embodiment of the invention comprises a guide means having two levels which provide eight alternations of the motion transmitting member during the course of each revolution of the rotary means. Common to each type of guide means are two dimensions derived from the motion transmitting member. Those dimensions are the follower radius and the center-to-center distance between the axes of the followers, and they are used to generate circle segments which are combined to form the closed path contours of each type of guide means.

The relative speed variations between the two rotary means during each alternation can, for any given center-to-center distance between follower axes, be selected by choosing the length for the portion of the motion transmitting member which extends outwardly from the axis of the follower means to the joint means. The length chosen must be the same for both portions in order to maintain the longitudinal symmetry of the motion transmitting member. The relationship is inverse and thus an increase in the length chosen will result in a lesser difference in relative speeds.

Accordingly, one object of this invention is to provide an improved transfer mechanism for controlling the relative rotational movement between piston assemblies in toroidal rotary combustion engines, and for use in other applications which utilize repetitive sequential controlled variations in the relative rotational speeds, or the relative angular rotational travel, of two rotary means.

It is another object of this invention to provide a durable, inexpensively manufactured, compact transfer mechanism of flexible design which may, at the time of manufacture, be easily configured to meet different requirements regarding the number of alternations which occur during each revolution, as well as the relative difference in speeds occuring during each alternation.

It is another object of this invention to provide a transfer mechanism which takes advantage of cam and follower construction and yet still allows changes to occur in the relative rotational speed between two rotary means without requiring either rotary means to be alternately brought to rest and then accelerated.

These and other objects and advantages of this invention will become readily apparent to one skilled in this art upon a detailed examination of the appended drawings and study of the description thereof which follows.

BEST MODE FOR CARRYING OUT THE INVENTION

Referring now to the figures, wherein like numerals refer to like parts, and particularly to FIGS. 1*a*–1*h*, two coaxial rotatable hubs are shown which bear four vanes each. The vanes on each hub are mounted perpendicular to the hub's rotational axis and are uniformly spaced apart about the hub at 90 degree intervals. Vane A1 and vane B1 are marked for reference in order to illustrate the "cat-and-mouse" alternations provided by the transfer mechanism of this invention. FIGS. 1*a*–1*h* are based upon the embodiment of the invention which provides eight alternations per revolution.

Figure 1A:
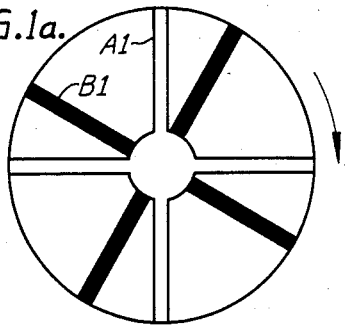
FIGS. 1*a*, 1*b*, 1*c*, 1*d*, 1*e*, 1*f*, 1*g* and 1*h* are schematic cross-sectional views illustrating consecutive operational positions of an embodiment of the invention which provides eight alternations per revolution.
Figure 1E:
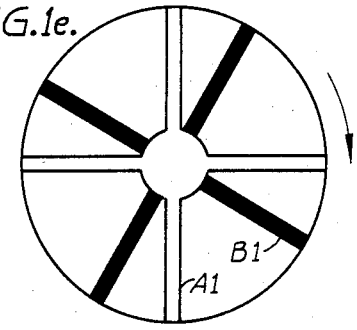
Figure 1B:
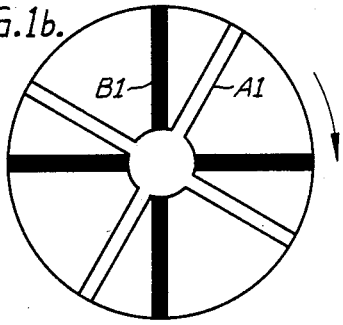
Figure 1F:
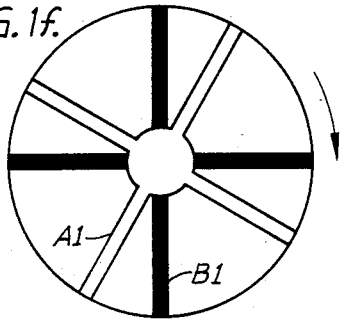
Figure 1C:
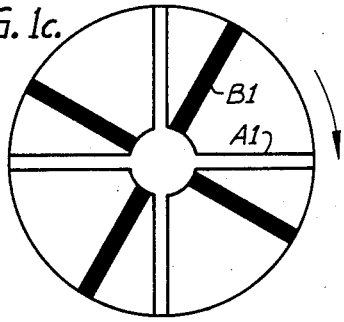
Figure 1G:
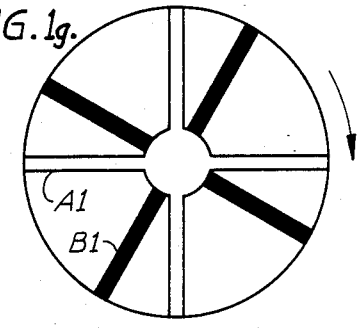
Figure 1D:
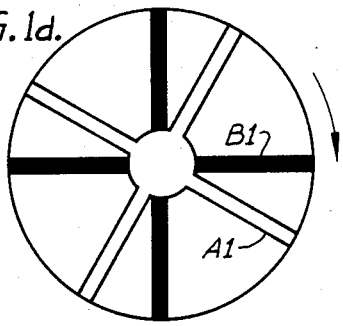
Figure 1H:
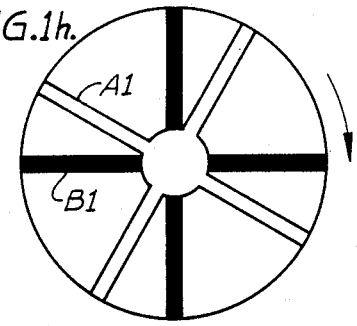

In FIG. 1*a*, vane A1 is shown in a position which is 60 degrees in advance of vane B1. After the hubs have rotated in a clockwise direction to the position shown in FIG. 1*b*, vane A1 has advanced only 30 degrees whereas vane B1 has advanced 60 degrees. Further rotation of the hubs to the positions shown in FIG. 1*c* shows vane A1 as having advanced another 60 degrees, but with vane B1 having advanced only another 30 degrees.

This cycle of vane B1 sequentially approaching vane A1, and then receding from vane A1, occurs four times during each revolution of the hubs for a total of eight alternations per revolution. The remaining sequential positions of the two vanes are shown in FIGS. 1*d*–1*h*. One revolution of the hub is completed by the clockwise rotation from the position shown in FIG. 1*h* to the position shown in FIG. 1*a*. Although a toroidal rotary internal combustion engine is not an object of this invention, it can be seen that the alternating contraction and expansion of the space between vane A1 and vane B1 parallels the sequentially varying volume associated with the intake, compression, combustion and exhaust phasing of such engines.

Figure 5:
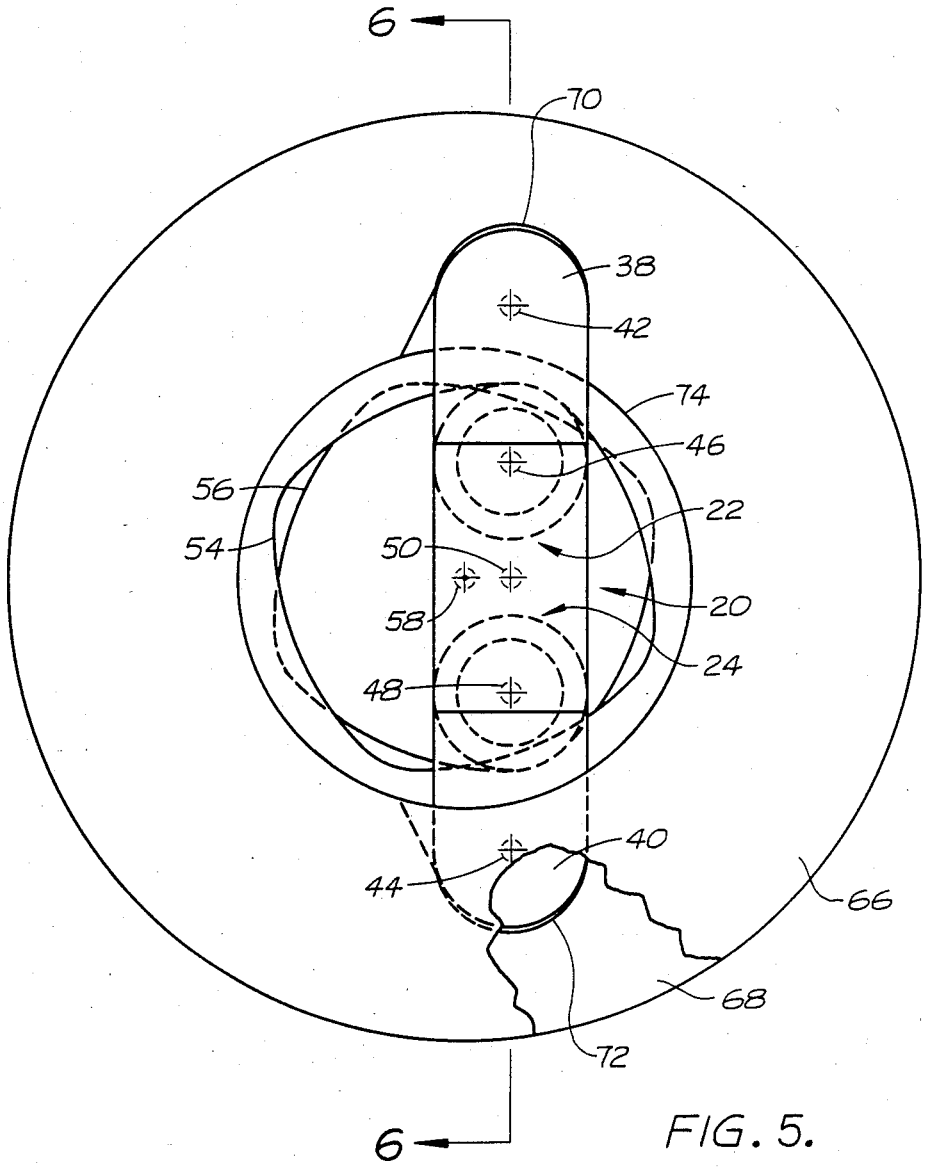
FIG. 5 is a plan view, including both rotary means, of an embodiment of the invention having a two-level guide means.

FIG. 5 illustrates a preferred embodiment of the invention comprising hub 66, hub 68, first level cam 54, second level cam 56, and a motion transmitting member which is generally designated by the numeral 20. The embodiment shown in FIG. 5 is of the type which provides eight alternations during the course of each revolution of the hubs 66, 68.

Figure 6:
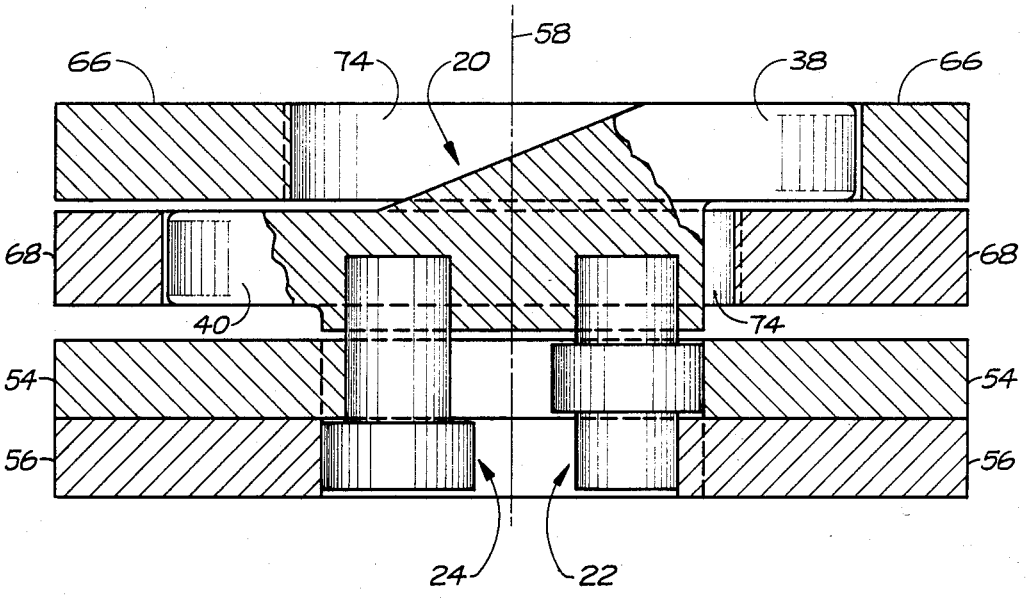
FIG. 6 is a sectional side elevation, partially broken away, taken along cutting line 6—6 of the embodiment shown in FIG. 5.

As shown in FIGS. 5 and 6, hub 66 and hub 68 are positioned adjacent and parallel to each other and are both rotatable about the first axis 58. Hub 66 and hub 68 are merely representative of the various types and configurations of rotary means which can be utilized in connection with the transfer mechanism of this invention. The simplified form of hubs 66, 68 is chosen here merely as an aid to clarity of illustration. Circular hub center openings 74, which are centered upon the first axis 58, are provided in each hub to provide clearance for motion transmitting member 20.

Figure 2:
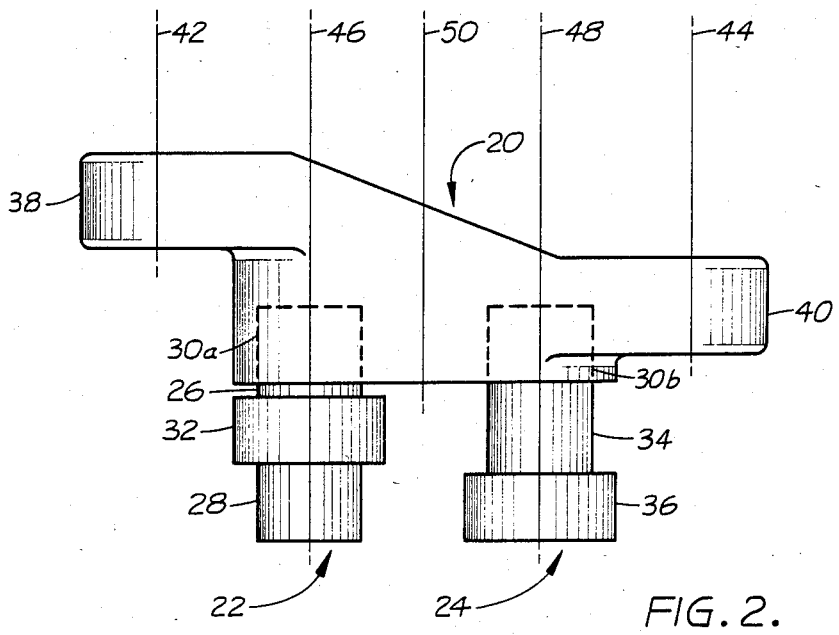
FIG. 2 is a side elevation of a motion transmitting member for use with a guide means having two levels.
Figure 3:
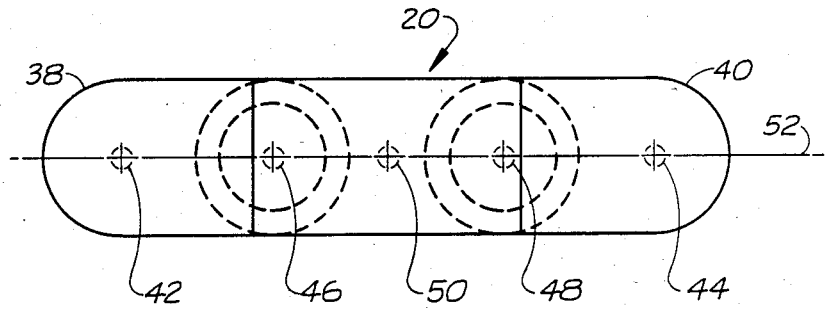
FIG. 3 is a plan view of a motion transmitting member.

The motion transmitting member 20 pivotally connects between hub 66 and hub 68. The pivotal connection between the motion transmitting member 20 and hub 66 is a first joint means comprised of slot 70 and tongue 38, and the pivotal connection to hub 68 is a second joint means comprised of slot 72 and tongue 40. As best seen in FIGS. 2 and 3 the pivotal motion of tongue 38 occurs about a second axis 42 and the pivotal motion of tongue 40 occurs about a third axis 44. Axes 42, 44 are parallel to the first axis 58 and spaced apart from the first axis 58 and from each other. As best seen in FIG. 5, the sides of slots 70, 72 symmetrically diverge from each other as they approach hub center opening 74 in order to provide clearance for the pivoting action of the motion transmitting member 20. Also, slots 70, 72 are slightly elongated to produce a clearance beyond the ends of tongues 38, 40. These latter clearances are required to accomodate the fact that all of the pivotal movements associated with motion transmitting member 20 occur about axes which are spaced apart from the first axis 58. The pivotal connections comprised of tongues 38, 40 and slots 70, 72 are also merely representative, and various types of pivotal connections which are known to the art may be conveniently substituted as a matter of engineering discretion based upon a specific application.

As shown in FIGS. 2 and 3, motion transmitting member 20 is formed as a transverse beam with tongues 38, 40 being integrally formed therewith and extending outwardly from a center portion having a rectangular cross section. As shown in FIG. 2, tongue 38 and tongue 40 are vertically offset from each other in order to maintain alignment with their respective associated hubs. FIG. 3 shows the axes 42, 44 for the pivotal connection to the hubs 66, 68 as being perpendicular to the longitudinal centerline 52 of motion transmitting member 20 and equidistant from the midpoint 50 of said centerline.

Mounted upon the center portion of motion transmitting member 20, and located below the levels of tongues 38, 40, are two follower assemblies which are generally designated by the numerals 22 and 24, respectively. Follower assembly 22 is a first follower means comprised of upper shank portion 26, lower shank portion 22 and follower collar 32, all of which are substantially cylindrical about a fourth axis 46. Follower assembly 24 is a second follower means comprised of shank portion 34 and follower collar 36, both of which are substantially cylindrical about a fifth axis 48. Axes 46 and 48 are each perpendicular to the longitudinal centerline 52 of motion transmitting member 20 and are parallel to the first axis 58. Also, axes 46 and 48 are spaced apart from each other at locations which are equidistant from the midpoint 50 of the longitudinal centerline 52 of motion transmitting member 20 and, which are intermediate between said midpoint 50 and the second axis 42 or third axis 44, respectively. Bores 30*a* and 30*b* provide a means for mounting follower assemblies 22 and 24 to motion transmitting member 20. Shank portion 26 of follower assembly 22 and shank 34 of follower assembly 24 are sized for a press fit within their respective associated bores. The shank portions of follower assemblies 22, 24 are of equal diameter. Follower collar 32 and follower collar 36 are also of equal diameter. However, the diameter of the follower collars 32, 36 is greater than that of their associated shank portions in order to provide clearance between the follower assemblies 22, 24 and the guide means. Follower collar 32 is vertically offset from follower collar 36 so that each follower collar will be guided by a separate level of the guide means.

Figure 4:
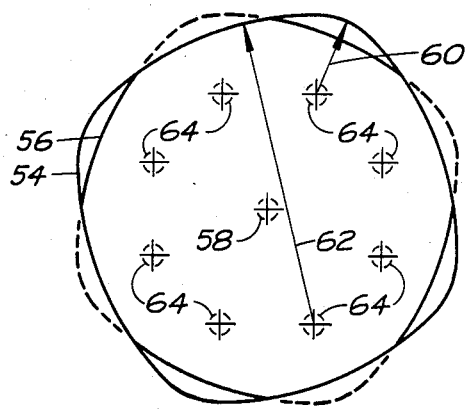
FIG. 4 is a plan view of a two level guide means that provides eight alterations per revolution.

The guide means for the embodiment shown in FIG. 5 is best seen in FIG. 4. This guide means is comprised of two cam levels; a first level cam 54 and a second level cam 56. Follower collar 32 bears against and is guided by the inwardly facing surface of first level cam 54, and follower collar 36 bears against and is guided by the inwardly facing surface of second level cam 56. The two cam levels are located in adjacent planes which are perpendicular to and centered upon first axis 58, and they have identical contours with one cam level being axially rotated 45 degrees with reference to the other cam level. The contour of each cam level is a closed path comprised of tangent alternating segments of two circles, i.e., a first circle having a first radius 60 and a second circle having a second radius 62. The first radius 60 is equal to the radius of follower collars 32, 36. The second radius 62 is equal to the sum of the first radius 60 plus the distance between the follower axes, i.e., between the fourth axis 46 and the fifth axis 48. Each centerpoint 64 for both the first circle segments and the second circle segments, as well as the fourth axis 46 and the fifth axis 48, lie within the area bounded by the closed path contours of both cam levels 54, 56. All of the centerpoints 64 are radially spaced an equal distance from the first axis 58 and uniformly spaced apart about the first axis 58 such that a straight line bisecting opposite circle segments will pass through the centerpoints 64 of said segments and through the first axis 58. Phrased differently, the eight centerpoints 64 of the guide means shown in FIG. 4 are coincident with the vertices of the largest plane octagon which will fit within a square that is centered upon the first axis 58 and which has sides equal in length to the distance between the fourth axis 46 and the fifth axis 48; i.e., the distance between the follower axes. It is possible to construct a functional guide means with each of the cam levels 54, 56 being comprised of only four circle segments with each segment having a radius equal to second radius 62, but it has been found preferable in practice to utilize the two radii as shown in FIG. 4.

In operation, and for purposes of illustration, hub 66, as shown in FIG. 5, is subjected to a driving torque and is caused to rotate in a clockwise direction at a substantially uniform speed. As hub 66 is rotated, slot 70 drivingly bears against tongue 38 and thereby causes motion transmitting member 20 to pivot or angularly rotate about the fourth axis 46. The pivoting of motion transmitting member 20 about the fourth axis 46 causes tongue 40 to drivingly bear against slot 72 of hub 68 and thereby cause hub 68 to also rotate in a clockwise direction. This first pivoting motion of motion transmitting member 20 continues until follower assembly 24 has followed second cam level 56 and completed the traverse of a single segment of the second circle defined by radius 62 and has come to rest against the next subsequent first circle segment defined by radius 60.

As hub 66 continues to rotate, it continues to drivingly bear against tongue 38. It is at this juncture that the pivot point for the pivoting action of motion transmitting member 20 shifts from the fourth axis 46 to the fifth axis 48 which, in turn, causes follower assembly 22 to follow first cam level 54 until follower assembly 22 has come to rest against the next subsequent first circle segment defined by radius 60. This second pivoting action of motion transmitting member 20 once again causes tongue 40 to drivingly bear against slot 72 thereby causing hub 68 to continue to rotate in a clockwise direction.

Although both hubs 66 and 68 have continued to rotate during both of the above described pivoting actions of motion transmitting member 20, they have not been rotating at the same rotation speed. During the first pivot action, the angular rotation of hub 68 is greater than the angular rotation of hub 66. This is because the distance between the fourth axis 46 and the second axis 42 is less than the distance between the fourth axis 46 and the third axis 44. Thus, during the first pivoting action of motion transmitting member 20, it is seen that the third axis 44, which is the axis for the pivotal connection between motion transmitting member 20 and hub 68, will sweep through a greater number of degrees of arc than will the second axis 42, which is the axis for the pivotal connection between motion transmitting member 20 and hub 66. During the second pivoting action of motion transmitting member 20, the relationship of the distances between the pivot point and the axes 42 and 44 are reversed from that which existed during the first pivoting action. This is because the pivot point shifted from the fourth axis 46 to the fifth axis 48. Accordingly, during the second pivoting action of motion transmitting member 20, the second axis 42 will sweep through a greater number of degrees of arc than will the third axis 44. For the embodiment shown in FIG. 5, this alternation of the pivot point back and forth between the fourth axis 46 and the fifth axis 48 will occur eight times during the course of each revolution of hubs 66, 68, thereby producing the relative rotational speed variations illustrated in FIG. 1.

For any given single pivoting action of motion transmitting member 20, adding the number of degress of arc traveled by the second axis 42 to the number of degrees of arc travelled by the third axis 44 will always yield the sum of 90 degrees. The relative speed variations between the two hubs 66, 68 can be selected by first holding the distance constant between the fourth axis 46 and the fifth axis 48, and then making equal and symmetrical changes to the distance between the fourth axis 46 and the second axis 42, and to the distance between the fifth axis 48 and the third axis 44. The relationship is inverse and thus an increase in the length chosen will result in a lesser difference in relative speeds. However, since most applications for the transfer mechanism of this invention require a significant difference in relative speeds, it is expected that axes 42, 44 will be located relatively closely to their respective adjacent follower axes 46, 48 which allows the device to remain compact in size.

Figure 7:
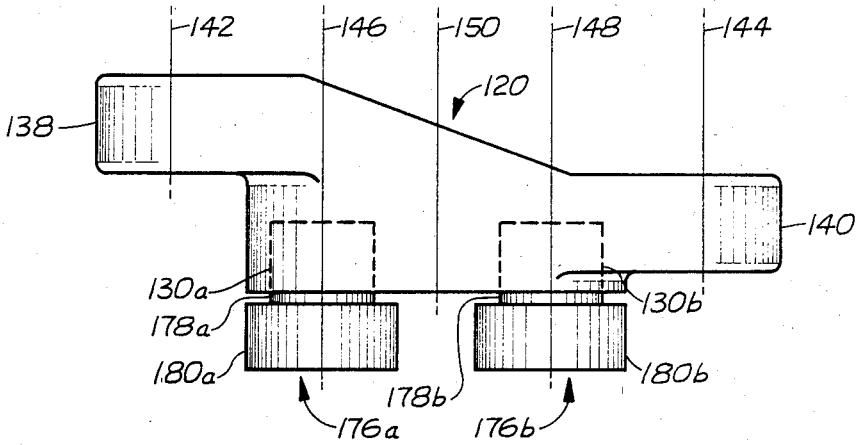
FIG. 7 is a side elevation of a motion transmitting member for use with a guide means having a single level.
Figure 8:
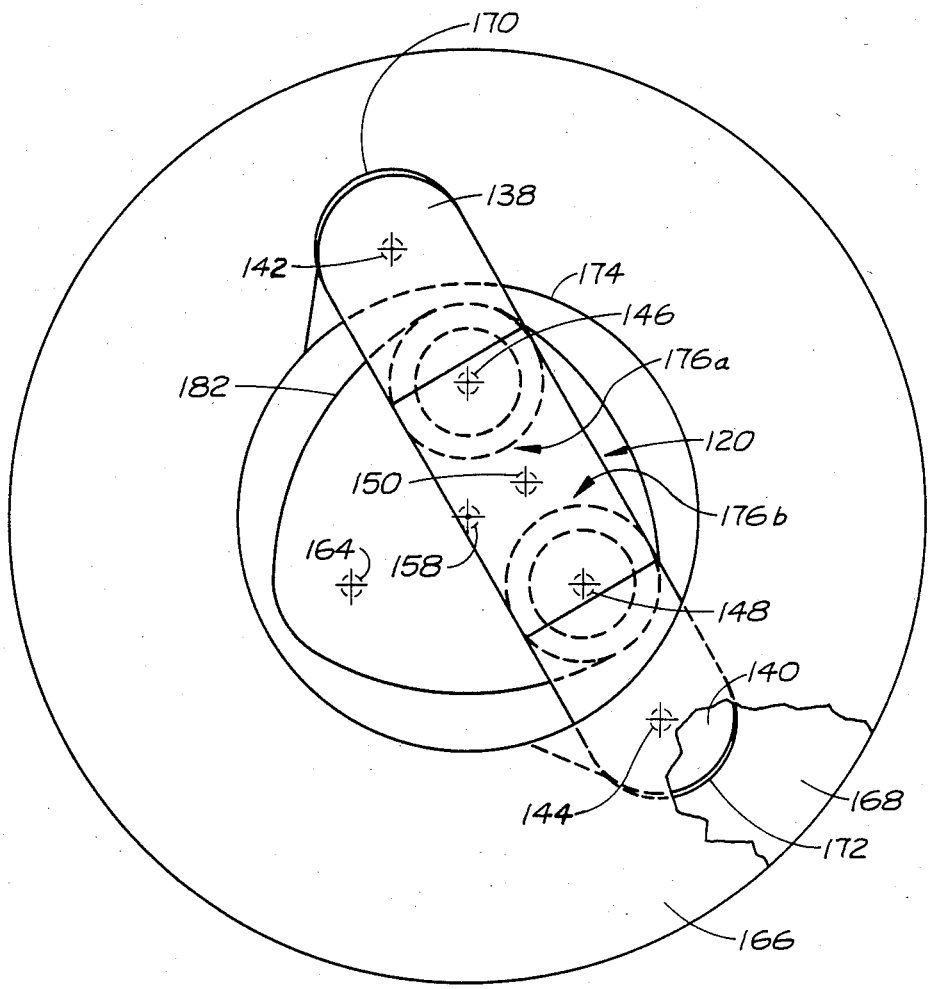
FIG. 8 is a plan view, including both rotary means, of an embodiment of the invention having a single level guide means.

Another example of the transfer mechanism of this invention is the embodiment shown in FIGS. 6 and 7. This embodiment uses a single level cam 182 which has a closed path contour comprised of tangent alternating segments of the same first circle and second circle as were used to define the contours of the first level cam 54 and the second level cam 56 of the embodiment shown in FIG. 5. The centerpoints 164 for the first and second circles of cam 182 exhibit the same relationship to first axis 158 as was described in connection with the previous embodiment, except that here there are only three centerpoints 164 which, in the embodiment being presently described, are coincident with the vertices of an equilateral triangle which is centered upon first axis 158 and which has sides equal in length to the distance between the fourth axis 146 and the fifth axis 148. As shown in FIG. 7, and because the cam 182 has only a single level, the follower assemblies **176*a*, 176*b* are identical to each other in all respects with the exception of their mounting location upon motion transmitting member 120; i.e., follower assembly 176*a* being mounted upon the fourth axis 146 and follower assembly 176*b* being mounted upon the fifth axis 148. In all other respects, motion transmitting member 120 is a duplicate of motion transmitting member 20 which was previously described. Likewise, hubs 166, 168 are duplicates of their counterpart hubs 66, 68**.

In operation, the embodiment shown in FIGS. 6 and 7 will provide six alternations in relative speed for each revolution of hubs 166, 168. Also, for any given single pivoting action of motion transmitting member 120, adding the number of degrees of arc travelled by the second axis 142 to the number of degrees of arc travelled by the third axis 144 will always yield the sum of 120 degrees. As in the previous embodiment, relocation of the second axis 142 and the third axis 144 will result in a change in the relative speed variations between the two hubs 166, 168.

Though not shown in the drawings, it is possible to construct other embodiments of the transfer mechanism of this invention. Whereas the previously described embodiments utilized guide means shown in the form of a separate plate for each level, it is possible to fabricate the guide means from a single piece of material as, for example, by milling the contours into an internal end surface of a stationarily mounted case for a toroidal rotary internal combustion engine. Yet another example would be an embodiment which has hub 66 located on one side of the guide means and hub 68 located on the opposite side of the guide means. This latter embodiment would necessarily require that the motion transmitting member 20 be modified from those that have been previously described. This modification would be accomplished by adding shank extensions to the follower assemblies 22, 24 and by moving one tongue, appropriately bored to accept the shank extensions, to the other side of the guide means in order to maintain alignment with the new location of the second hub. Finally, any of the embodiments described may be modified by the substitution of rollers mounted for axial rotation about fourth axis 46 and the fifth axis 48; said rollers being substituted for the previously described non-rotatable follower collars 32, 36.

INDUSTRIAL APPLICABILITY

The transfer mechanism apparatus of this invention may be advantageously utilized as a component machine element to control the relative rotational movement between piston assemblies in toroidal rotary combustion engines. It may also be used for the same purpose in toroidal fluid compressors, pumps, and the like. Other applications which may advantageously utilize repetitive sequential controlled variations in the relative rotational speeds, or the relative angular rotational travel, of two rotary means will be apparent to those skilled in the art.

The components of the apparatus of this invention may be readily fabricated using the machinery, tooling, and general skills typically associated with the manufacture of conventional internal combustion engines and the like. Engineering choices based upon a particular application will determine whether forgings, castings, rod stock, or plate stock should be used for specific component parts. Suitable bearings, when required, are widely stocked and readily available.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the legitimate and valid scope of the appended claims appropriately interpreted in accordance with the "doctrine of equivalents".

I claim:

1. Transfer mechanism for controlling the rotational movement of one rotary means relative to the rotational movement of a second rotary means, comprising in combination:

first rotary means having a first axis;

second rotary means rotatable about said first axis;

motion transmitting means including a motion transmitting member;

first joint means having a second axis and located at one end of said motion transmitting member for pivotally connecting said motion transmitting member to said first rotary means;

second joint means having a third axis and located at the other end of said motion transmitting member for pivotally connecting said motion transmitting member to said second rotary means;

said second axis and said third axis both being perpendicular to the longitudinal center line of said motion transmitting member, equidistant from the mid-point of said longitudinal center line, parallel to said first axis, and spaced apart from said first axis and from each other;

first follower means having a fourth axis, said fourth axis being spaced apart from said first, second, and third axis;

second follower means having a fifth axis, said fifth axis being spaced apart from said first, second and third axis;

said first and said second follower means both being substantially cylindrical about their respective axes and being of equal diameter;

said first and said second follower means being mounted upon said motion transmitting member with their respective axes being parallel to said first axis and perpendicular to the longitudinal center line of said motion transmitting member, said axes of said first and second follower means being spaced apart from each other, equidistant from said mid-point of said longitudinal center line of said motion transmitting member, and intermediate between said mid-point and said second or said third axis, respectively;

guide means for receiving and cooperating with said first and second follower means, said guide means having a contour being defined by a plurality of segments of a circle, said circle having a radius equal to the sum of the radius of said follower means plus the distance between said fourth axis and said fifth axis, said circle segments together forming a closed path surrounding said first, fourth, and fifth axes and also containing the centerpoints of said circle segments;

said center points of said circle segments all being radially spaced an equal distance from said first axis, and uniformly spaced apart about said first axis, such that a straight line bisecting opposite circle segments will pass through the center points of said segments and through said first axis;

said guide means and said follower means causing said motion transmitting member to firstly angularly rotate about said fourth axis, and then to secondly angularly rotate about said fifth axis, with the pivot point of said angular rotation continuing to alternate between said fourth and fifth axes whereby said motion transmitting member, and through said joint means, alternately rotates said second rotary means at speeds which are relatively faster than, and then relatively slower than, said first rotary means during each revolution of said first rotary means.

2. The transfer mechanism of claim 1 wherein the contour of said guide means is comprised of three of said circle segments.

3. The transfer mechanism of claim 1 wherein the guide means is comprised of a first level and a second level, said first level of said guide means being axially rotated about said first axis 45 degrees with reference to said second level of said guide means, and with said mounting of said first and second follower means upon said motion transmitting member being adapted to allow said first follower means to be received by and cooperate with said first level of said guide means and to allow said second follower means to be received by and cooperate with said second level of said guide means.

4. The transfer mechanism of claim 3 wherein said first level and said second level of said guide means have identical contours, with each of said identical contours being comprised of four of said circle segments.

5. Transfer mechanism for controlling the rotational movement of one rotary means relative to the rotational movement of a second rotary means, comprising in combination:

first rotary means having a first axis;

second rotary means rotatable about said first axis;

motion transmitting means including a motion transmitting member;

first joint means having a second axis and located at one end of said motion transmitting member for pivotally connecting said motion transmitting member to said first rotary means;

second joint means having a third axis and located at the other end of said motion transmitting member for pivotally connecting said motion transmitting member to said second rotary means;

said second axis and said third axis both being perpendicular to the longitudinal center line of said motion transmitting member, equidistant from the mid-point of said longitudinal center line, parallel to said first axis, and spaced apart from said first axis and from each other;

first follower means having a fourth axis, said fourth axis being spaced apart from said first, second, and third axis;

second follower means having a fifth axis, said fifth axis being spaced apart from said first, second and third axis;

said first and said second follower means both being substantially cylindrical about their respective axes and being of equal diameter;

said first and said second follower means being mounted upon said motion transmitting member with their respective axes being parallel to said first axis and perpendicular to the longitudinal center line of said motion transmitting member, said axes of said first and second follower means being spaced apart from each other, equidistant from said mid-point of said longitudinal center line of said motion transmitting member, and intermediate between said mid-point and said second or said third axis, respectively;

guide means for receiving and cooperating with said first and second follower means, said guide means having a contour being defined by a plurality of tangent alternating segments of a first circle and of a second circle, said first circle having a radius equal to the radius of said follower means, and said second circle having a radius equal to the sum of the radius of said first circle plus the distance between said fourth axis and said fifth axis, said alternating first and second circle segments together forming a closed path surrounding said first, fourth, and fifth axes and also containing the center points of said first circle segments and of said second circle segments;

said center points of said first and second circles all being radially spaced an equal distance from said first axis, and uniformly spaced apart about said first axis, such that a straight line bisecting opposite circle segments will pass through the center points of said segments and through said first axis;

said guide means and said follower means causing said motion transmitting member to firstly angularly rotate about said fourth axis, and then to secondly angularly rotate about said fifth axis, with the pivot point of said angular rotation continuing to alternate between said fourth and fifth axes whereby said motion transmitting member, and through said joint means, alternately rotates said second rotary means at speeds which are relatively faster than, and then relatively slower than, said first rotary means during each revolution of said first rotary means.

6. The transfer mechanism of claim 5 wherein the contour of said guide means is comprised of three segments of said first circle alternated with three segments of said second circle.

7. The transfer mechanism of claim 5 wherein the guide means is comprised of a first level and a second level, said first level of said guide means being axially rotated about said first axis 45 degrees with reference to said second level of said guide means, and with said mounting of said first and second follower means upon said motion transmitting member being adapted to allow said first follower means to be received by and cooperate with said first level of said guide means and to allow said second follower means to be received by and cooperate with said second level of said guide means.

8. The transfer mechanism of claim 7 wherein said first level and said second level of said guide means have identical contours, with each of said identical contours being comprised of four segments of said first circle alternated with four segments of said second circle.

9. The transfer mechanism of claim 1 or 5 wherein said first and second follower means comprise rollers mounted for axial rotation about said fourth and fifth axes respectively.

10. The transfer mechanism of claim 1 or 5 wherein said first and second rotary means are located on the same side of said guide means.

11. The transfer mechanism of claim 1 or 5 wherein said first and second rotary means are located on opposite sides of said guide means.

12. The transfer mechanism of claim 1 or 5 wherein said guide means is fixedly mounted in a stationary position.

13. The transfer mechanism of claim 1 or 5 wherein the magnitude of the relative speed variations between said first and second rotary means is a function of the location of said second axis and said third axis.

* * * * *